US008975565B2

(12) United States Patent
Strassman et al.

(10) Patent No.: US 8,975,565 B2
(45) Date of Patent: Mar. 10, 2015

(54) INTEGRATED PROPULSION AND ATTITUDE CONTROL SYSTEM FROM A COMMON PRESSURE VESSEL FOR AN INTERCEPTOR

(75) Inventors: Doron Strassman, Vail, AZ (US); Mark E. Elkanick, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 211 days.

(21) Appl. No.: 13/551,221

(22) Filed: Jul. 17, 2012

(65) Prior Publication Data

US 2014/0061364 A1 Mar. 6, 2014

(51) Int. Cl.

| | |
|---|---|
| ***F42B 10/66*** | (2006.01) |
| ***F42B 15/01*** | (2006.01) |
| *F42B 10/00* | (2006.01) |
| *F42B 15/00* | (2006.01) |

(52) U.S. Cl.

CPC ..... *F42B 10/663* (2013.01); *F42B 15/01* (2013.01)

USPC ..... 244/3.22; 244/3.1; 244/3.15; 244/3.21; 244/3.24

(58) Field of Classification Search

CPC ..... F41G 7/20; F41G 7/22; F41G 7/24; F41G 7/26; F41G 7/28; F41G 7/30; F42B 10/02; F42B 10/04; F42B 10/12; F42B 10/14; F42B 10/60; F42B 10/62; F42B 10/64; F42B 15/01

USPC ..... 244/3.1–3.3, 158.1, 164, 169; 239/265.11, 265.19, 265.25–265.31; 60/200.1, 228, 229

See application file for complete search history.

(56) References Cited

U.S. PATENT DOCUMENTS

| | | | | | |
|---|---|---|---|---|---|
| 2,726,510 | A | * | 12/1955 | Goddard | 239/265.27 |
| 2,937,496 | A | * | 5/1960 | Caillette | 239/265.27 |
| 2,965,334 | A | * | 12/1960 | McCullough, Jr. et al. | 244/3.22 |
| 2,968,454 | A | * | 1/1961 | Merrill et al. | 244/3.22 |
| 3,057,581 | A | * | 10/1962 | Tumavicus | 244/3.22 |
| 3,058,304 | A | * | 10/1962 | Corbett | 239/265.25 |
| 3,208,383 | A | * | 9/1965 | Larson | 60/229 |
| 3,304,029 | A | * | 2/1967 | Ludtke | 244/3.2 |
| 3,325,121 | A | * | 6/1967 | Banaszak et al. | 244/3.22 |
| 3,350,886 | A | * | 11/1967 | Ferand et al. | 60/229 |
| 3,446,023 | A | * | 5/1969 | Mosier | 244/3.22 |
| 3,532,304 | A | * | 10/1970 | Pyptiuk | 244/3.22 |
| 3,554,448 | A | * | 1/1971 | Nerwer | 239/265.25 |
| 3,614,027 | A | * | 10/1971 | Lewis | 244/3.22 |
| 3,732,693 | A | * | 5/1973 | Chu | 60/229 |
| 3,779,012 | A | * | 12/1973 | Suter | 244/3.22 |
| 3,788,069 | A | * | 1/1974 | Schmidt | 60/229 |
| 3,802,190 | A | * | 4/1974 | Kaufmann | 244/3.22 |
| 3,807,657 | A | * | 4/1974 | Brill | 60/200.1 |
| 3,826,087 | A | * | 7/1974 | McDonald | 60/200.1 |
| 3,977,629 | A | * | 8/1976 | Tubeuf | 244/3.22 |

(Continued)

*Primary Examiner* — Bernarr Gregory
(74) *Attorney, Agent, or Firm* — Eric A. Gifford

(57) ABSTRACT

An interceptor is provided with an integrated propulsion and attitude control system (ACS) in which propellant burn forms a common pressure vessel for high-pressure gas. An aft port in the rocket motor directs gas through one or more main nozzles that expel high-velocity gas in a generally axial direction to propel the interceptor. A forward port directs gas through one or more attitude control nozzles that expel high-velocity gas in a generally radial direction to control the attitude of the interceptor. The main nozzle(s) and stabilization fins are fixed, there is no servo control to the main nozzles or fins to affect attitude control. The use of a common pressure vessel enables an integrated propulsion and ACS that can be compact, lightweight and inexpensive.

17 Claims, 7 Drawing Sheets

(56) References Cited

U.S. PATENT DOCUMENTS

| | | | | | |
|---|---|---|---|---|---|
| 3,977,633 | A * | 8/1976 | Keigler et al. | 244/169 |
| 4,408,735 | A * | 10/1983 | Metz | 244/3.22 |
| 4,413,795 | A * | 11/1983 | Ryan | 244/3.22 |
| 4,726,544 | A * | 2/1988 | Unterstein | 244/3.22 |
| 5,123,611 | A * | 6/1992 | Morgand | 244/3.22 |
| 5,456,425 | A * | 10/1995 | Morris et al. | 244/3.22 |
| 6,267,326 | B1 * | 7/2001 | Smith et al. | 244/3.22 |
| 6,393,830 | B1 * | 5/2002 | Hamke et al. | 60/229 |
| 6,502,384 | B1 * | 1/2003 | Onojima et al. | 60/229 |
| 7,741,588 | B2 * | 6/2010 | Gundel et al. | 244/3.15 |

* cited by examiner

3-AXIS ATTITUDE CONTROL
- 1 + 2 = LEFT PITCH
- 4 + 3 = RIGHT PITCH
- 1 + 4 = DOWN YAW
- 2 + 3 = UP YAW
- 1 + 3 = COUNTERCLOCKWISE ROLL
- 2 + 4 = CLOCKWISE ROLL

INTEGRATED PROPULSION AND ATTITUDE CONTROL SYSTEM FROM A COMMON PRESSURE VESSEL FOR AN INTERCEPTOR

BACKGROUND OF THE INVENTION

1. Field of the Invention

This invention relates to attitude control systems for a self-propelled interceptor.

2. Description of the Related Art

Interceptors such as self-propelled rockets, missiles or counter-missile missiles may be launched from air, land or sea-based platforms to engage a target. The interceptor may be used offensively against other platforms, fixed emplacements or other targets or defensively to intercept and destroy enemy missiles. The interceptor may use explosive or kinetic energy to defeat the target.

The interceptor is propelled by a rocket motor. Rocket propellant is ignited and burns creating a high-pressure gas. This gas is expelled in a generally axial direction through one or more main nozzles that convert the high-pressure gas into a high-velocity gas.

The interceptor is maneuvered by an attitude control system (ACS). In general, the ACS produces a "moment" offset from the center of gravity (Cg) of the interceptor that interacts with the main axial thrust vector to change the attitude of the interceptor. This moment may provide yaw, pitch and/or roll control. One approach known as "thrust vector control" uses a servo motor to physically reorient the one or more main nozzles to produce the desired moment. Another approach known as "aerodynamic control" uses servo motor to physically deploy one or more aerodynamic control surfaces such as fins. Some interceptors use a combination of thrust vector control at low speed with aerodynamic control at high speed. Another approach is to selectively ignite one or more explosive guidance units (EGUs) placed on the airframe to generate impulse moments to control the attitude. In any of these approaches, a flight control system responds to guidance commands to command the ACS to maneuver the interceptor. Guidance may be provided as a command line-of-sight (CLOS) in which a targeting system tracks the target and the interceptor, calculates the appropriate guidance commands that will result in an intercept and send these commands to the interceptor to execute, a "beamrider" in which an IR sensor mounted aft of the interceptor "rides" an IR beam from the platform to the target, or a Homing Guidance (active, semi-active or passive) in which a sensor mounted forward of the interceptor locks onto the target.

SUMMARY OF THE INVENTION

The following is a summary of the invention in order to provide a basic understanding of some aspects of the invention. This summary is not intended to identify key or critical elements of the invention or to delineate the scope of the invention. Its sole purpose is to present some concepts of the invention in a simplified form as a prelude to the more detailed description and the defining claims that are presented later.

The present invention provides an integrated propulsion and attitude control system (ACS) for an interceptor.

This is accomplished by providing the interceptor with a rocket motor having ports both forward and aft of the rocket propellant. Propellant burn forms a common pressure vessel for high-pressure gas to provide both propulsion and attitude control. One or more main nozzles in communication with the aft port convert high-pressure gas into a high-velocity gas that is expelled in a generally axial direction to propel the interceptor. The main nozzle(s) and stabilization fins are fixed, there is no servo control to the main nozzles or fins to affect attitude control. An ACS comprises one or more fixed attitude control nozzles in communication with the forward port to convert high-pressure gas into a high-velocity gas and expel the high-velocity gas in generally radial directions offset from the interceptor Cg to change the attitude of the interceptor. In an embodiment in which the main nozzle(s) are configured to produce a rolling airframe, a single attitude control nozzle provides both pitch and yaw control. In another embodiment, a set of four attitude control nozzles provides pitch, yaw and roll control. The multi-nozzle configurations may share a common throat for converting the high-pressure gas to high-velocity gas. A flight control system responsive to guidance commands, commands one or more valves to control the flow of the high-velocity gas through the one or more attitude control nozzles to maneuver the interceptor.

These and other features and advantages of the invention will be apparent to those skilled in the art from the following detailed description of preferred embodiments, taken together with the accompanying drawings, in which:

DETAILED DESCRIPTION OF THE INVENTION

The present invention provides an integrated propulsion and attitude control system (ACS) for an interceptor. Propellant burn forms a common pressure vessel for high-pressure gas. An aft port in the rocket motor directs gas through one or more main nozzles that expel high-velocity gas in a generally axial direction to propel the interceptor. A forward port directs gas through one or more attitude control nozzles that expel high-velocity gas in a generally radial direction to control the attitude of the interceptor. The main nozzle(s) and stabilization fins are fixed, there is no servo control to the main nozzles or fins to affect attitude control.

The use of a common pressure vessel enables an integrated propulsion and ACS that can be compact, lightweight and inexpensive. The elimination of a second energy source to power the ACS, and specifically servo motors for mechanical control, streamlines the ACS and reduces the overall size, weight and cost of the combined propulsion and ACS. These attributes are generally desirable and are in particularly necessary for interceptors configured as counter-missile missiles in which the interceptor must be quite small and inexpensive.

Without loss of generality, the integrated propulsion and ACS will be described for an embodiment of a counter-missile missile launched from an airborne platform such as a jet fighter, helicopter or unmanned aerial vehicle (UAV). For context and clarity, an embodiment of a weapons system that employs the interceptor and the engagement CONOPS for using the interceptor to engage a MANPADS launched missile and the MANPADS operator are presented.

Figure 1:
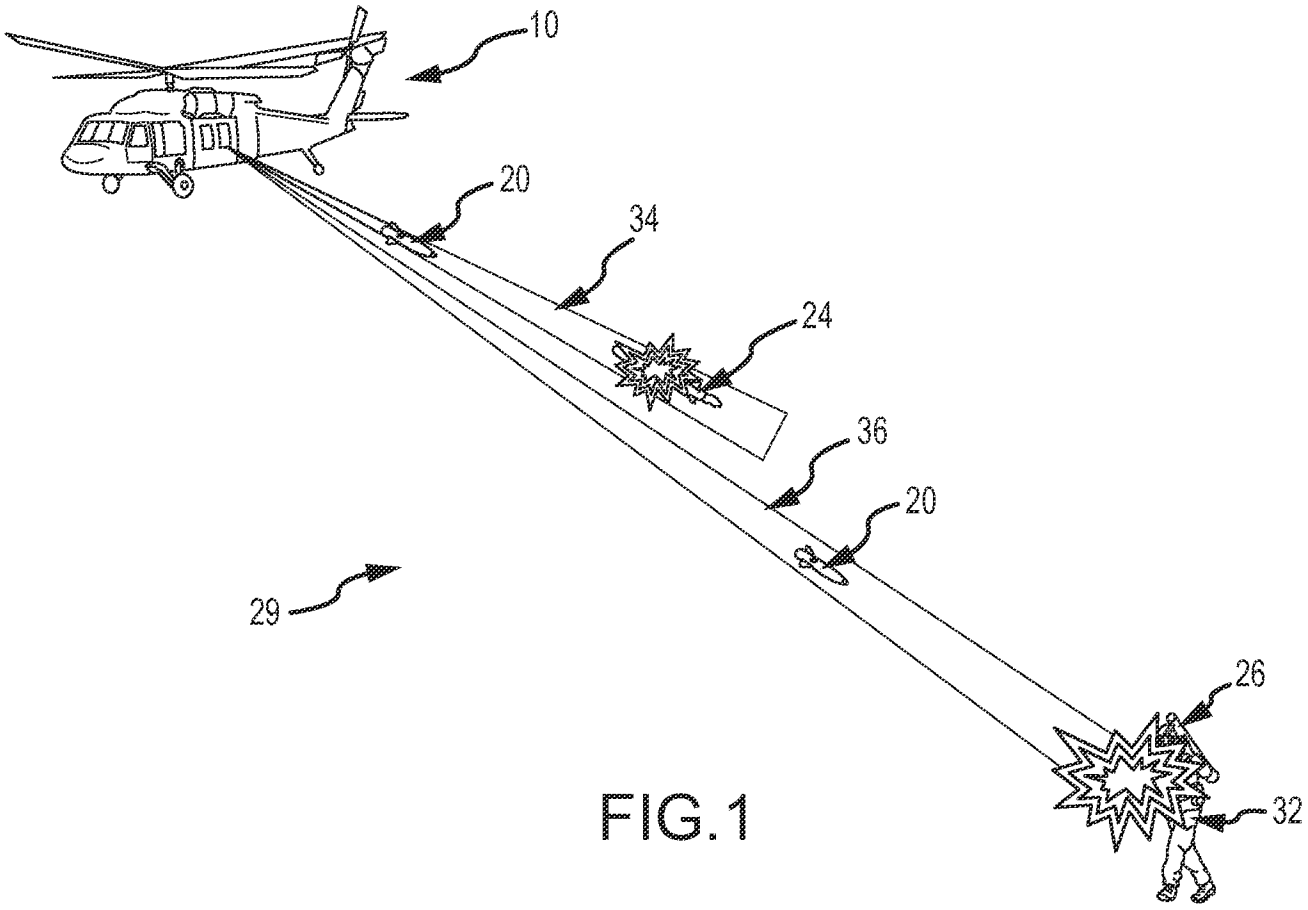
FIG. 1 is a diagram of engagement CONOPOS for firing an interceptor in accordance with the present invention from a helicopter to engage and defeat a MANPADs threat.
Figure 2:
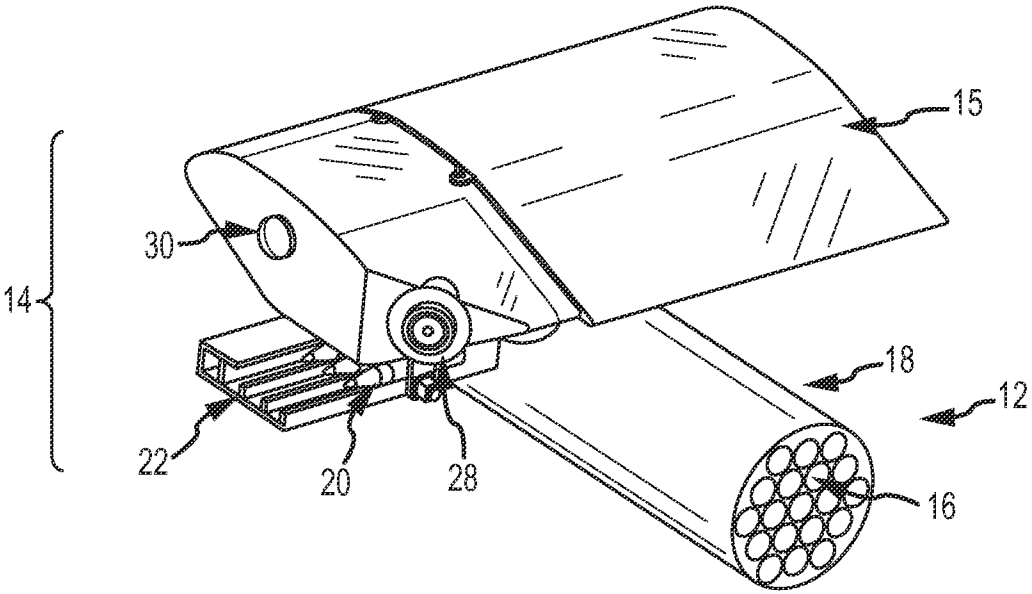
FIG. 2 is a diagram of the interceptors and other systems mounted on a helicopter wing for engaging and defeating the MANPADS threat.

Referring now to FIGS. 1 and 2, in an embodiment a helicopter 10 is provided with a tube-launched missile system 12 for offensive engagement of targets and a counter-threat missile system 14 for defensive operations to protect the helicopter. These systems may be mounted on a wing 15 of helicopter 10. Tube-launched missile system 12 launches missiles 16 such as Hydra 70 System that are launched from a tube 18 and designed to engage and defeat air-to-air or air-to-ground target packages. Accordingly, these missiles need the range and explosive or kinetic energy to defeat targets such as other helicopters, airplanes, tanks, ground installations etc. Counter-threat missile system 14 launches interceptors 20 from a launcher pod 22 in response to a detected threat such as a rocket 24 launched from a MANPADS 26. The system suitably includes a missile-warning sensor 28 to detect threat launches with a field-of-view (FOV) 29 and a directed infrared counter measures (DIRCM) system 30 (See U.S. Pat. No. 7,378,626) to track the threat and provide guidance to interceptor 20. Accordingly, the interceptors are designed to engage and defeat the rocket and possibly the MANPADS operator 32. As such, the interceptor requires limited range and firepower but must be small, lightweight and inexpensive while exhibiting the necessary thrust and maneuverability to engage the threat. These requirements render conventional ACS approaches such as thrust vector control and aerodynamic control impractical.

In a typical engagement scenario, missile-warning sensor 28 detects a threat launch of rocket 24, which activates DIRCM system 30 to track the incoming rocket with a laser beam 34. The helicopter's defense system selects the counter-threat missile system 14 to engage the threat and launch interceptor 20. In this embodiment, interceptor 20 has an aft facing IR sensor that rides laser beam 34 to engage and defeat rocket 24. Alternately, the interceptor may have a forward facing IR seeker to acquire, track and perform end game maneuvers. Or the interceptor may be configured for command line-of-sight (CLOS) guidance. A UAV in the theater of operations may detect the launch of rocket 24 from MANPADS 26 and direct DIRCM system 30 to illuminate the MANPADS 26 with a laser beam 36. Counter-threat missile system 14 launches a second interceptor 20 that rides laser beam 36 to engage and defeat the MANPADS launcher 26 and operator 32.

In an alternate scenario, the helicopter surveillance system detects the MANPADS launcher and operator as a potential threat and activates the DIRCM system 30 to acquire and track the MANPADS launcher 30. Counter-threat missile system 14 fires a pair of interceptors 20 in quick succession. Operator 30 fires the MANPADS rocket 24. Missile warning sensor 28 detects the MANPADS launch. The DIRCM system acquires the rocket 24 and directs the first interceptor 20 to engage and defeat the rocket. The second interceptor 20 holds its original course. After the rocket is defeated, the DIRCM system reacquires the MANPADS launcher and operator and the second interceptor 20 resumes beam rider guidance to engage and defeat the MANPADS launcher and operator.

Figure 3A:
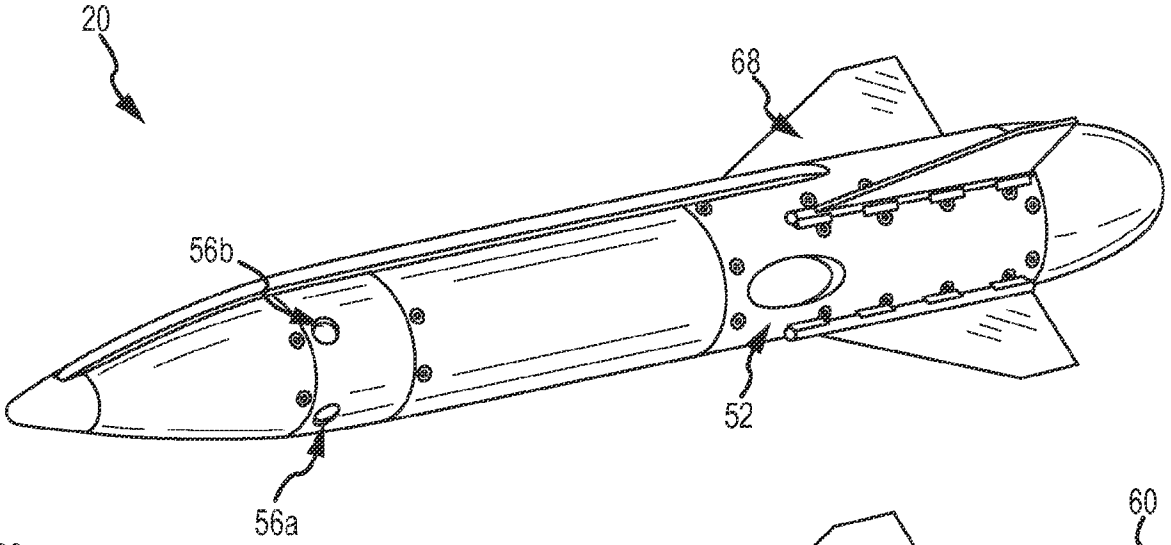
FIGS. 3*a* and 3*b* are perspective and cut-away views of an embodiment of the interceptor revealing the common pressure vessel for integrated propulsion and ACS.
Figure 3B:
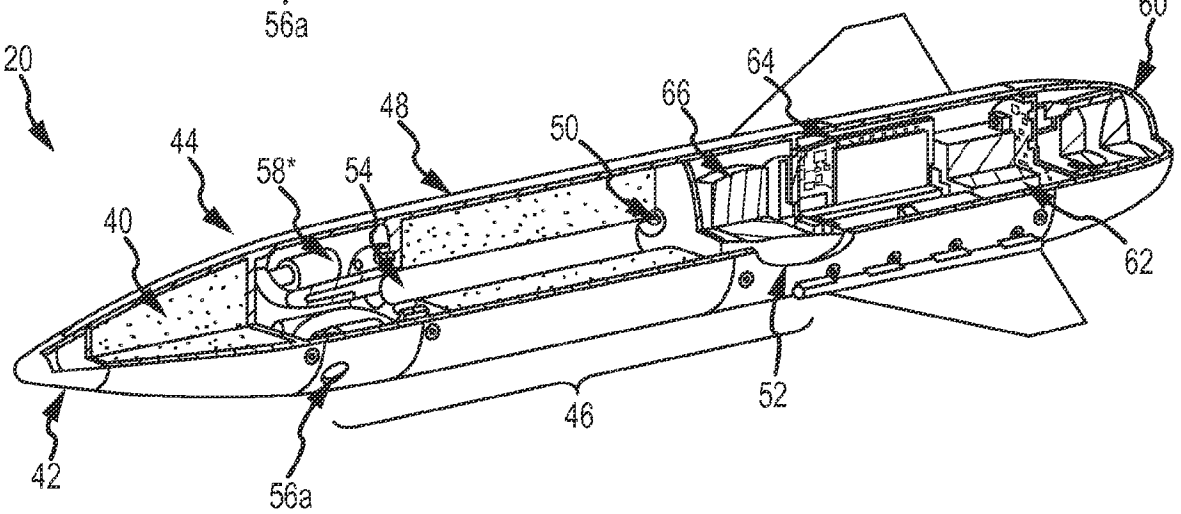

Referring now to FIGS. 3*a* and 3*b*, an embodiment of interceptor 20 comprises a warhead 40 and a target detection module 42 for detonating warhead 40 in the nose of an airframe 44. Target detection module 42 may include a proximity or impact sensor to trigger detonation. A mid-body integrated propulsion and ACS 46 placed behind the warhead includes a rocket motor 48 that burns propellant to form a common pressure vessel. An aft port 50 in the rocket motor directs gas through a pair of fixed main nozzles 52 on opposite sides of the air frame that expel high-velocity gas in a generally axial direction to propel the interceptor. A forward port 54 directs gas through four fixed attitude control nozzles 56*a*, 56*b*, 56*c* and 56*d* that expel high-velocity gas in a generally radial direction to control the attitude of the interceptor. Valves 58*a*, 58*b*, 58*c* and 58*d* are commanded in pairs to control the flow of high-velocity gas through the nozzles to maneuver the interceptor in yaw, pitch and roll. The beam rider IR sensor 60, electronics for the guidance system 62 that produces guidance commands and the flight control system 64 that is responsive to those commands to command the ACS 46, and more particularly valves 58*a*-58*d*, to maneuver the interceptor, and a battery 66 to power the electronics, valves and other systems on the interceptor are placed at the aft end of the interceptor. Four fixed fins 68 provide aerodynamic stabilization for the interceptor. The main nozzle(s) 52 and stabilization fins 68 as well as the attitude control nozzles 56*a*-5*d* are positionally fixed, there is no servo control to change the orientation of the main nozzles or fins to affect attitude control.

The use of a common pressure vessel to provide energy to both propel and maneuver the interceptor combined with the elimination of all servo control for ACS allows for an ACS and overall interceptor that is small, lightweight and inexpensive. In an embodiment, the interceptor is less than approximate 6.8 kilograms (15 pounds), 61 cm (15 inches) in length and 8 cm (3 inches) in diameter. These weights and dimensions are merely exemplary for a counter-missile missile but illustrate the ability to provide full 3-axis attitude control in a small interceptor. The ACS does consume energy provided by the rocket motor that is not available for propulsion. In a typical counter-missile missile the ACS will consume less than 10% of the energy produced from propellant burn.

Figure 4:
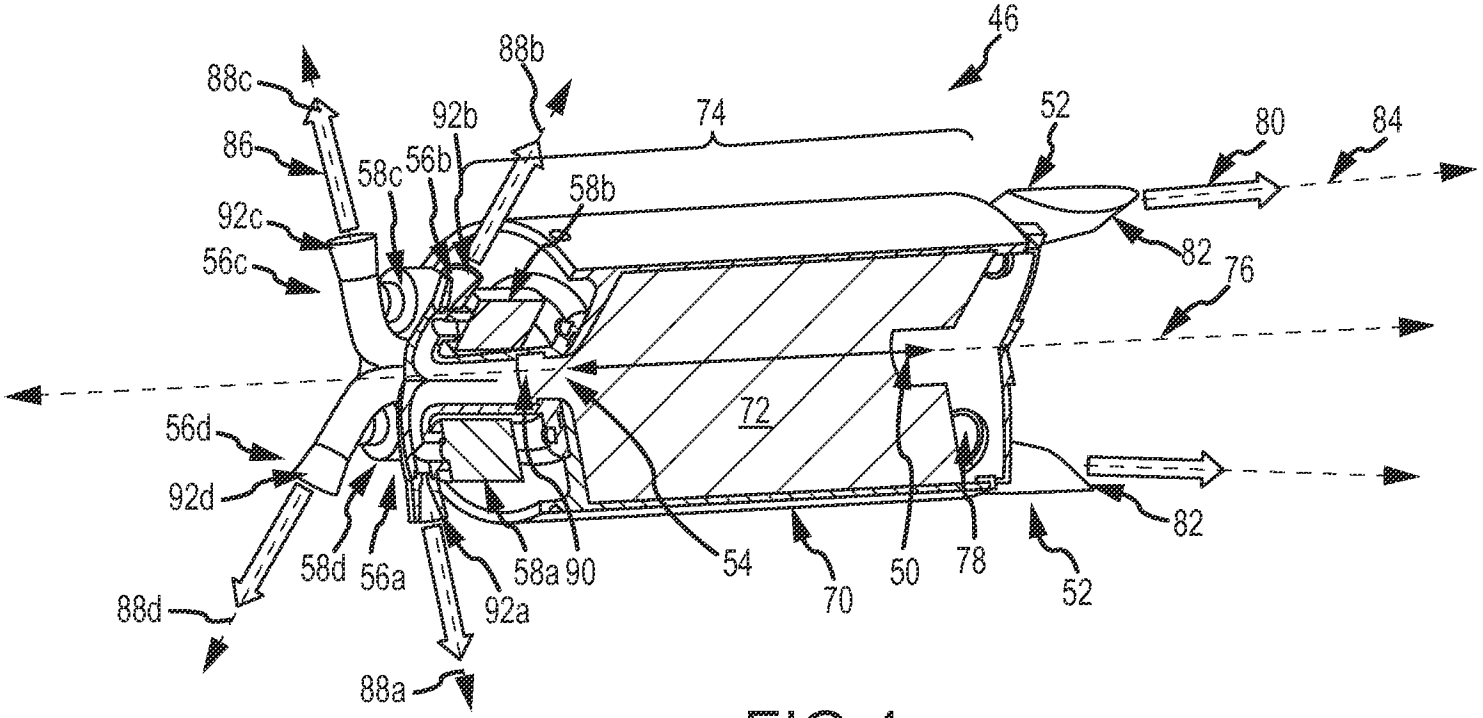
FIG. 4 is a cut-away view of an embodiment of the integrated propulsion and ACS from the common pressure vessel.
Figure 5:
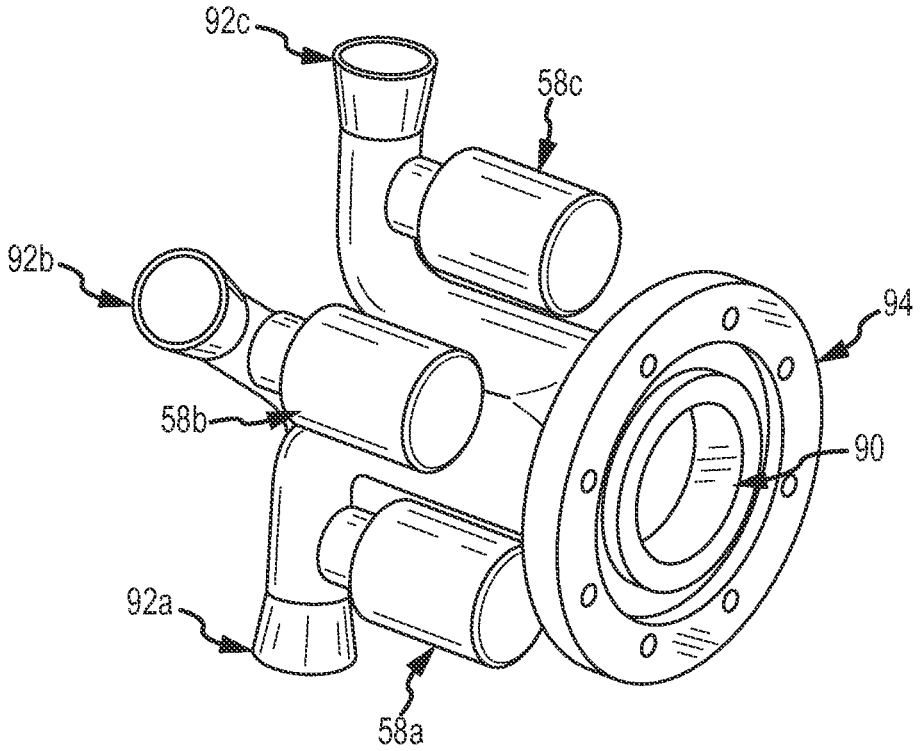
FIG. 5 is a perspective view of an embodiment of the ACS for providing yaw, pitch and roll control.

Referring now to FIGS. 4 and 5, the integrated propulsion and ACS 46 includes rocket motor 48 that comprises a cylindrical motor can 70 having ports 54 and 50 forward and aft, respectively and a rocket propellant 72 therein. Propellant burn forms a common pressure vessel 74 with can 70 for high-pressure gas. In this embodiment, rocket propellant 72 is formed with a cylindrical hole along a longitudinal axis 76 of the interceptor. When ignited, rocket propellant 72 burns radially inside-to-out forming a single combustion chamber coextensive with the common pressure vessel. In an alternate embodiment, rocket propellant 72 is solid. When ignited, the propellant burns axially from both ends forming a pair of combustion chambers on either side of the remaining rocket propellant.

The pair of fixed main nozzles 52 receive high-pressure gas from common pressure vessel 74 through all port 50, convert the high-pressure gas to a high-velocity gas and expel the gas in a generally axial direction (along longitudinal axis 76) to propel the interceptor. For the mid-body design, the main nozzles must be canted to expel the high-velocity gas outside the airframe. In general, the nozzles are canted to remove any non-axial thrust. However, the nozzles may be canted to produce a moment with respect to the axial thrust vector that produces roll to create a rolling airframe. For an aft-body design, a single main nozzle may be oriented along the longitudinal axis. To induce roll, the main nozzle may be formed with helical flutes.

Each main nozzle 52 has an associated throat 78 that converts the high-pressure gas to high-velocity gas 80 and an output port 82 that expels the high-velocity gas in a generally axial direction 84. In this embodiment, each main nozzle 52 has its own throat 78 to convert the high-pressure gas to high-velocity gas inside the nozzle. In an alternate embodiment, the main nozzles could share a common throat.

The four fixed attitude control nozzles 56*a*, 56*b*, 56*c* and 56*d* receive high-pressure gas from common pressure vessel 74 through forward port 54, convert the high-pressure gas to a high-velocity gas 86, and expel high-velocity gas 86 in generally radial directions 88*a*, 98*b*, 88*c* and 88*d* (approximately normal to longitudinal axis 76) to control the attitude of the interceptor in pitch, yaw and roll. The nozzles may be canted forward a couple of degrees e.g. 1-3 degrees to compensate for the velocity of the airstream so that the resulting force vectors more closely approximate a true radial direction orthogonal to the longitudinal axis. The expulsion of high-velocity gas 86 through any one or more of the nozzles produces a moment with respect to the main thrust vector along longitudinal axis 76. This moment may cause the interceptor to yaw, pitch or roll.

Each attitude control nozzle 56*a*, 56*b*, 56*c* and 56*d* has an associated throat 90 that converts the high-pressure gas to high-velocity gas 86 and an output port 92*a*, 92*b*, 92*c* and 92*d* that expels the high-velocity gas in the generally radial directions 88*a*, 98*b*, 88*c* and 88*d*. In this embodiment, the attitude control nozzles share a common throat 90. A manifold 94 provides the common throat 90 to meter and direct flow of the high-velocity gas 86 to the four output ports 92*a*, 92*b*, 92*c* and 92*d* via the four valves 58*a*, 58*b*, 58*c* and 58*d*. In an embodiment, the common throat 90 is a Mach 1 choke port. The use of a common throat, as opposed to individual throats within each nozzle, provides a uniform metered flow rate for each nozzle.

Figure 6:
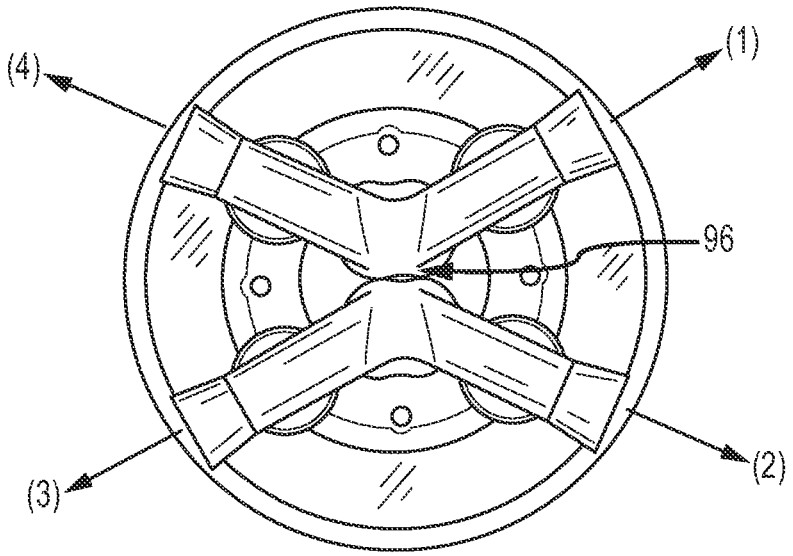
FIG. 6 is a diagram of an embodiment of an asymmetric nozzle arrangement in which different pairs of nozzles are actuated to provide yaw, pitch and roll control.

Referring now to FIG. 6, the output ports of the four attitude control nozzles are labeled "1", "2", "3" and "4" to illustrate an embodiment for providing yaw, pitch and roll control. Each of the output ports is offset from the center 96 of the interceptor (and from the Cg of the interceptor) to produce a moment with respect to the main axial thrust vector. Actuating the valves for "1" and "2" produces a moment that causes the interceptor to pitch left. Actuating the valves for "3" and "4" produces a moment that causes the interceptor to pitch right. Actuating the valves for "1" and "4" produces a moment that causes the interceptor to yaw down. Actuating the valves for "2" and "3" produces a moment that causes the interceptor to yaw up. Actuating the valves for "1" and "3" produces a moment that causes the interceptor to roll counter clockwise. Actuating the valves for "2" and "4" produces a moment that causes the interceptor to roll clockwise. It will be apparent to one skilled in the art that there are other configurations of more or less attitude control nozzles that produce 3-axis attitude control.

Figure 7:
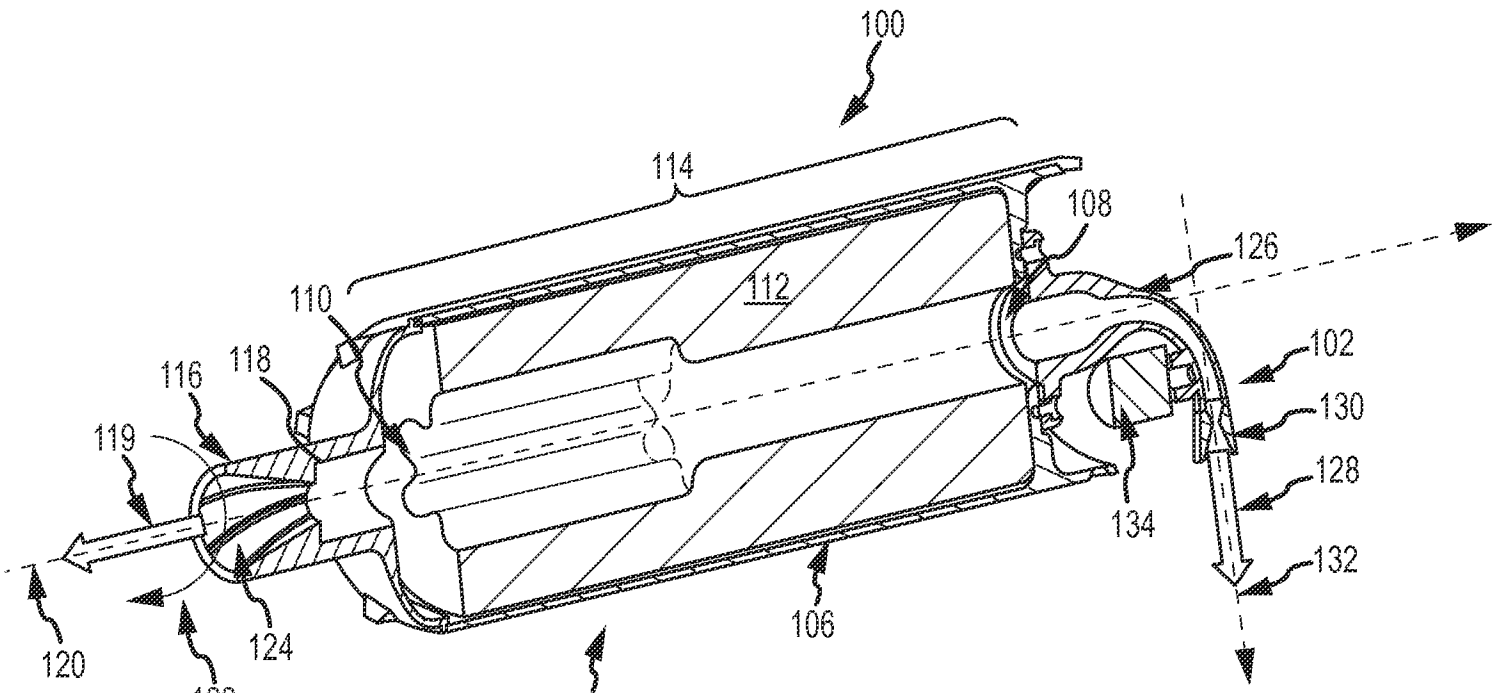
FIG. 7 is a cut-away of an embodiment in which a single attitude control nozzle provides yaw and pitch control to a rolling airframe/

Referring now to FIG. 7, an embodiment of an integrated propulsion and ACS 100 produces a rolling airframe and 2-axis pitch and yaw control with a single attitude control nozzle 102. System 100 includes a rocket motor 104 comprising a motor can 106 having ports 108, 110 forward and aft and a rocket propellant 112 therein. Propellant burn forms a common pressure vessel 114 for high-pressure gas. A fixed main nozzle 116 having a throat 118 in communication with the aft port 100 and the common pressure vessel converts high-pressure gas into a high-velocity gas 119 and expels the high-velocity gas in a generally axial direction 120 to propel the interceptor and to impart roll 122 to the interceptor. In this embodiment, the main nozzle 116 is formed with helical flutes 124 to impart the roll. In an alternate embodiment, a pair of main nozzles could be canted to impart the roll. Single fixed attitude control nozzle 102 has a throat 126 in communication with the forward port 108 and the common pressure vessel to convert high-pressure gas into a high-velocity gas 128 and expel the second high-velocity gas through an output port 130 in a generally radial direction 132 offset from a center of gravity (Cg) of the interceptor. A valve 134 controls the flow of the high-velocity gas through the attitude control nozzle.

The creation of the common pressure vessel to provide a single source of high-pressure gas to both propel the interceptor and provide attitude control is critical to providing an ACS and full-up interceptor that is small, lightweight and inexpensive with required maneuverability performance. However, the use of the common pressure vessel to source two different systems complicates the motor design process. The propellant grain design has to support the boost-sustain thrust profile requirement to maintain control via the main and attitude control nozzles all the way to the target. If both throats are sized correctly, an appropriate portion of the gas will flow to the rear and the rest to the front. The rocket motor and both throats must be designed and the nozzles controlled to main the common high-pressure vessel and flame front without causing overpressure when the attitude control thrust is not required. For a rocket motor that burns radially inside-to-out, propellant burn forms a common combustion chamber for both propulsion and attitude control. When attitude control thrust is not being used, the high-pressure is vented through the main nozzle. For a rocket motor that burns axially from both end, propellant burn forms a combustion chamber aft for propulsion and a combustion chamber forward for attitude control. If the valves for attitude control are normally closed, the forward combustion chamber may overpressure and cause the motor to fail. Operating the ACS with the valves in a normally open position vents the high-pressure gas and maintains conditions for efficient and safe motor operation.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. An interceptor, comprising:

an airframe;

a plurality of fixed aerodynamic stabilization fins on the airframe;

a rocket motor within the airframe, said motor comprising a motor can having ports forward and aft and a rocket propellant therein, wherein propellant burn forms a common pressure vessel for high-pressure gas;

one or more fixed main nozzles having a throat in communication with the aft port and the common pressure vessel to convert high-pressure gas into a first high-velocity gas and expel the first high-velocity gas in a generally axial direction to propel the interceptor;

an attitude control system (ACS) comprising, one or more fixed attitude control nozzles having a throat in communication with the forward port and the common pressure vessel to convert high-pressure gas into a second high-velocity gas and expel the second high-velocity gas through one or more output ports in generally radial directions offset from a center of gravity (Cg) of the interceptor to change the attitude of the interceptor; and one or more valves to control the flow of the second high-velocity gas through the one or more attitude control nozzles; and a flight control system responsive to guidance commands to command the one or more valves to direct flow through the one or more attitude control nozzles to maneuver the interceptor.

2. The interceptor of claim 1, wherein the interceptor is less than 6.8 kilograms, 61 cm in length and 8 cm in diameter.

3. The interceptor of claim 1, wherein the attitude control system uses less than 10% of the energy produced from propellant burn.

4. The interceptor of claim 1, wherein the rocket propellant is configured to either burn radially inside-to-out or axially from both ends.

5. The interceptor of claim 1, wherein the one or more main nozzles are configured to expel the first high-velocity gas to impart a roll to the interceptor, said one or more attitude control nozzles comprising a single attitude control nozzle that expels the second high-velocity gas through the output port in the generally radially direction to control pitch and yaw of the interceptor.

6. The interceptor of claim 1, where said one or more attitude control nozzles comprise first, second, third and fourth attitude control nozzles placed around the airframe to expel the second high-velocity gas through respective output ports in generally radially directions that are each offset from the center of the airframe to control pitch, yaw and roll of the interceptor.

7. The interceptor of claim 6, wherein each of the first, second, third and fourth attitude control nozzles includes its own throat.

8. The interceptor of claim 6, wherein the first, second, third and fourth attitude control nozzles share a common throat that converts the high pressure gas to the high-velocity gas.

9. The interceptor of claim 8, wherein the common throat comprises a Mach 1 choke port.

10. The interceptor of claim 6, wherein the valves are binary on/off valves, and wherein all the valves are normally on and are turned off to control pitch, yaw and roll.

11. An interceptor, comprising:

an airframe;

a plurality of fixed aerodynamic stabilization fins on the airframe;

a rocket motor within the airframe, said motor comprising a motor can having ports forward and aft and a rocket propellant therein, wherein propellant burn forms a common pressure vessel for high-pressure gas;

one or more fixed main nozzles having a throat in communication with the aft port and the common pressure vessel to convert high-pressure gas into a first high-velocity gas and expel the first high-velocity gas in a generally axial direction to propel the interceptor;

an attitude control system (ACS) comprising, four fixed attitude control nozzles including a common throat in communication with the forward port and the common pressure vessel to convert high-pressure gas into a second high-velocity gas and first, second, third and fourth output ports placed around the airframe offset from a center of gravity (Cg) of the interceptor to expel the second high-velocity gas in generally radially directions that are each offset from the center of the airframe to change the pitch, yaw and roll of the interceptor; and first, second, third and fourth valves to control the flow of the second high-velocity gas through the respective attitude control nozzles; and a flight control system responsive to guidance commands to command the one or more valves to direct flow through the attitude control nozzles to maneuver the interceptor in yaw, pitch and roll.

12. The interceptor of claim 11, wherein the flight control system commands different pairs of the four valves to direct flow of the second high-velocity gas through different pairs of the four attitude control nozzles to maneuver the interceptor in yaw, pitch and roll.

13. The interceptor of claim 11, wherein the interceptor is less than 6.8 kilograms, 61 cm in length and 8 cm in diameter.

14. The interceptor of claim 11, wherein the attitude control system uses less than 10% of the energy produced from propellant burn.

15. An interceptor, comprising:

an airframe;

a plurality of fixed aerodynamic stabilization fins on the airframe;

a rocket motor within the airframe, said motor comprising a motor can having ports forward and aft and a rocket propellant therein, wherein propellant burn forms a common pressure vessel for high-pressure gas;

one or more fixed main nozzles having a throat in communication with the aft port and the common pressure vessel to convert high-pressure gas into a first high-velocity gas and expel the first high-velocity gas in a generally axial direction to propel the interceptor and to impart roll to the interceptor;

an attitude control system (ACS) comprising, a single fixed attitude control nozzle having a throat in communication with the forward port and the common pressure vessel to convert high-pressure gas into a second high-velocity gas and expel the second high-velocity gas through an output port in a generally radial directions offset from a center of gravity (Cg) of the interceptor; and a valve to control the flow of the second high-velocity gas through the attitude control nozzle; and a flight control system responsive to guidance commands to command the valve to direct flow through the attitude control nozzle to maneuver the interceptor in yaw and pitch.

16. The interceptor of claim 15, wherein the interceptor is less than 6.8 kilograms, 61 cm in length and 8 cm in diameter.

17. The interceptor of claim 15, wherein the attitude control system uses less than 10% of the energy produced from propellant burn.

* * * * *